US007781690B2

(12) United States Patent
Ishii

(10) Patent No.: US 7,781,690 B2
(45) Date of Patent: Aug. 24, 2010

(54) KEY SHEET AND PRODUCTION METHOD THEREOF

(75) Inventor: Hisashi Ishii, Niigata (JP)

(73) Assignee: Sunarrow Limited, Tokyo (JP)

( * ) Notice: Subject to any disclaimer, the term of this patent is extended or adjusted under 35 U.S.C. 154(b) by 312 days.

(21) Appl. No.: 12/090,932

(22) PCT Filed: Oct. 24, 2006

(86) PCT No.: PCT/JP2006/321091

§ 371 (c)(1),
(2), (4) Date: Apr. 21, 2008

(87) PCT Pub. No.: WO2007/049572

PCT Pub. Date: May 3, 2007

(65) Prior Publication Data

US 2009/0236209 A1 Sep. 24, 2009

(30) Foreign Application Priority Data

Oct. 24, 2005 (JP) ..... 2005-308783

(51) Int. Cl.
*H01H 13/70* (2006.01)

(52) U.S. Cl. ..... 200/341; 200/314; 29/622

(58) Field of Classification Search ..... 200/5 A, 200/512, 341, 310, 314, 317; 341/22; 345/168–170; 29/622
See application file for complete search history.

(56) References Cited

U.S. PATENT DOCUMENTS 5,234,744 A * 8/1993 Kenmochi ..... 428/195.1
6,103,346 A * 8/2000 Nakajo et al. ..... 428/172
6,993,830 B2 * 2/2006 Shimizu et al. ..... 29/622
7,321,103 B2 * 1/2008 Nakanishi et al. ..... 200/512
7,378,607 B2 * 5/2008 Koyano et al. ..... 200/341
7,414,213 B2 * 8/2008 Hwang et al. ..... 200/341
7,488,910 B2 * 2/2009 Hong ..... 200/310
7,598,466 B2 * 10/2009 Tateda et al. ..... 200/341
7,663,071 B2 * 2/2010 Chang ..... 200/345

(Continued)

FOREIGN PATENT DOCUMENTS

EP 1467391 10/2004

(Continued)

OTHER PUBLICATIONS

"International Search Report and Written Opinion" for corresponding Application No. PCT/JP2006/321091, dated Nov. 28, 2006.

(Continued)

*Primary Examiner*—Michael A Friedhofer
(74) *Attorney, Agent, or Firm*—Westman, Champlin & Kelly, P.A.

(57) ABSTRACT

Portable phones are getting a trend that s design and thinner configuration becomes more important. Therefore, in order to meet this demand, the entire key top is made of a thin metal, and a thin resin layer is provided on the back surface of the key top and further letter holes are filled with a resin. According to those, the adhesiveness of the key top is improved as well as improvement of hand feeling. In addition, a printed layer for coloring the letters can be provided on the back surface of the key top.

7 Claims, 7 Drawing Sheets

U.S. PATENT DOCUMENTS

| | | | | |
|---|---|---|---|---|
| 7,671,290 | B2 * | 3/2010 | Chen et al. | 200/314 |
| 2005/0139460 | A1 | 6/2005 | Hosaka | 200/314 |

FOREIGN PATENT DOCUMENTS

| | | |
|---|---|---|
| JP | 08-007691 | 1/1996 |
| JP | 09-082174 | 3/1997 |
| JP | 2002-367468 | 12/2002 |
| JP | 2005-100964 | 4/2005 |
| JP | 2005/190849 | 7/2005 |
| KR | 20050017275 | 5/2005 |
| WO | WO 2005009945 | 3/2005 |

OTHER PUBLICATIONS

"Supplemental European Search Report" for Application 06812151.6-1231/1950781 PCT/JP2006321091; date Apr. 17, 2009; 8 pages.

"International Preliminary Report on Patentability and Written Opinion" from corresponding Application No. PCT/JP2006/321091.

* cited by examiner (a)

(b)

KEY SHEET AND PRODUCTION METHOD THEREOF

CROSS-REFERENCE TO RELATED APPLICATION

This Application is a Section 371 National Stage Application of International Application No. PCT/JP2006/321091, filed Oct. 24, 2006, published as WO 2007/049572, not in English, the content of which is hereby incorporated by reference in its entirety.

TECHNICAL FIELD

The present invention relates to a technology for thinning an entire key sheet on which a plurality of keys as a input means for handy mobile equipment such as a portable phone, a personal digital assistants (PDA) or the like are assembled and disposed, and for using a key top made of a metal so as to obtain a design which is different from that of a conventional key sheet which uses a key top made of a resin.

BACKGROUND ART

A key sheet is a component (subassembly) constituting a keyboard portion of a handy mobile equipment such as a portable phone, a personal digital assistant (PDA) or the like, and is configured such that a plurality of key tops made of a resin which are push buttons indicating a letter and/or a numerical key, a function key or the like respectively were adhered in an arrayed manner onto the top surface of a sheet referred to as a keypad. In many cases, polycarbonate or the like is usually used from the viewpoint of mold-ability, strength or the like as the above-mentioned resin material for the key top. Further, a soft material having rubber elasticity such as a silicone rubber, thermoplastic elastomer or the like is used as a keypad material. On the undersurface of the key sheet thus configured, a small projection referred to as a pressing element (a contact pressing projection) is provided for each of the above-mentioned key tops.

This key sheet is closely disposed on a printed circuit board provided with a plurality of normally open contacts. When any of the key tops arrayed on the top surface of the key sheet is pressed, a pressing element provided on the undersurface of the key sheet presses down a metal dome disposed at the underneath thereof, so that the normally open contact provided on the printed circuit board is closed. Therefore, a closed circuit corresponding to the pressed key top is formed.

Since the key sheet is thus configured such that a plurality of components are piled up in a layered manner, the thicknesses of each component is accumulated and it has substantial thickness. Therefore, it is requested that a whole handy mobile equipment should be further thinned so as to further enhance the portability thereof.

However, in a case where a resin is used for a key top as in the conventional key sheet, there is limitation for thinning a key top as one method for thinning an entire key sheet. For example, even in a material which is strong and excellent in impact resistance such as a polycarbonate resin, 0.5 mm to 0.6 mm is the thinnest limit in order to satisfy various conditions of strength required for a key top. Therefore, it can be considered to use a metal which is more excellent in strength than a resin and does not break even by applying excessive impact.

The following example is a conventional one using a metal for a key top, although it is different from the above-mentioned object. For example, in methods as disclosed in Patent References 1 and 2, even though a thin metal plate was used, only a flange portion of a key top is slightly formed out of a metal, and a resin was still used for other portions. Therefore it has simply a configuration of the conventional common layered structure formed by superposing a key top or the like made of a resin on a key pad. Therefore, it could not be expected to improve the strength of a key top, and in addition there is limitation for further thinning taking its structure into consideration.

[Patent Reference 1]

Japanese Laid-Open Patent [Kokai] Publication No. H-08-007691

[Patent Reference 2]

Japanese Laid-Open Patent [Kokai] Publication No. H-09-082174

When attempting to metalize an entire key top using a thin metal plate in order to improve the mechanical strength, another problem occurs. That is, it cannot be said that a metal has good adhesiveness to other materials such as a silicone rubber, a resin or the like, so that there is a case where sufficient adhesive strength could not be obtained. In addition, a metal cannot have translucency even though it try to be thinned. Therefore, in order to display letters, symbols or the like with a backlight, a hole penetrated from the front surface to the back surface for transmitting light in the shapes of letters, symbols or the like, so called letter holes must be carved. The edge of the carved letter holes would spoil the finger feeling or hand feeling of an operator who operates the key tops.

DISCLOSURE OF THE INVENTION

The purpose of the present invention is, in light of the above-mentioned problems, to improve the adhesiveness of a key top made of a metal to a keypad, and to even the surface of the key top so as to improve the finger feeling or hand feeling.

The present invention intends to improve the adhesiveness of a key top and to even the surface of the key top so as to improve the finger feeling or hand feeling by taking measures of layering a thin resin layer on the back surface of the key top and filling letter holes carved on the key top with a resin.

The subject intended to apply the above-mentioned improvement for adhesiveness is the adhesiveness of a key top made of a metal to a silicone rubber, a thermoplastic elastomer or the like at the key top fixed portion of a key pad. Further, the present invention also serves for preventing an adhesive from spilling out through letter holes at the time of adhering the key top to the key pad by filling a resin into the letter holes.

DETAILED DESCRIPTION OF THE INVENTION

Figure 1:
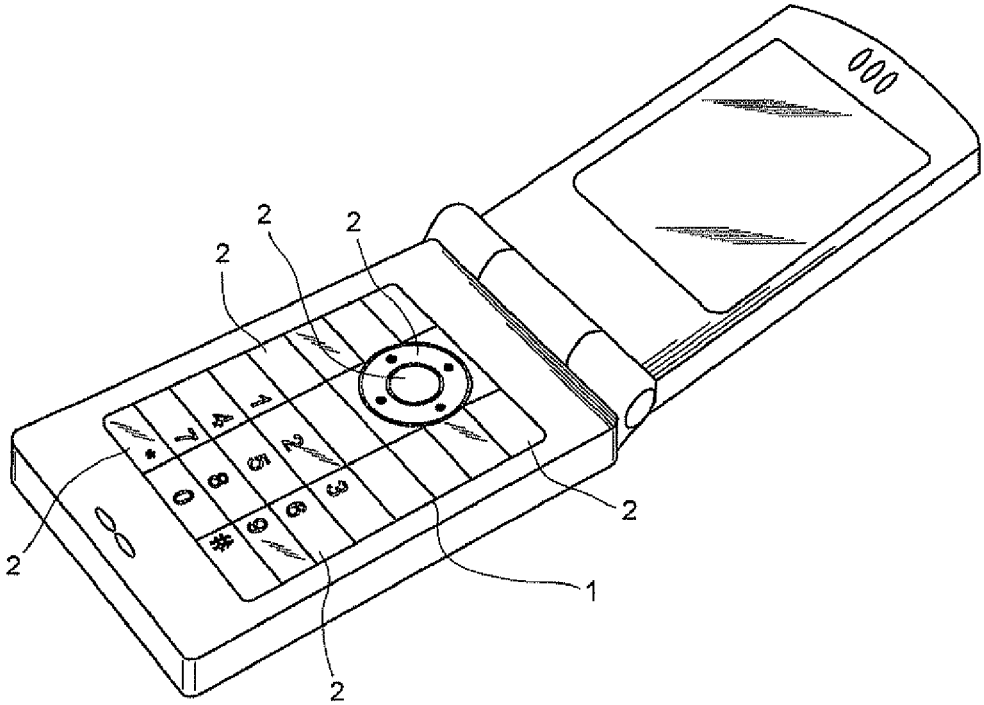
FIG. 1 is a perspective view of a portable phone into which a key sheet of the present invention is incorporated.

FIG. 1 is a perspective view of a portable phone into which a key sheet 1 of the present invention is incorporated. The key sheet 1 comprises a plurality of key tops 2, 2, . . . made of a metal which is thin, for example, with a thickness of about 0.15 to 0.5 mm (including the thickness of a resin layer as mentioned later). Functions are allocated to the respective key tops 2, and on the surface thereof, for example, letters, numerals, symbols, figures or the like (hereinafter, referred to as "letters, symbols or the like") showing the respective functions such as what is called ten key, cursor key, function key or the like are displayed by providing penetrated hole 2*a* in the shapes of letters, symbols or the like (hereinafter, referred to only as "letter hole") (only numerals are shown as one example). Further, a thin resin layer 3 is layered (see FIGS. 7 and 8) on the back surface of each key top 2. In addition, as a key sheet 1, what is called narrow pitch keys in which each key top 2 is arranged with a gap of 0.2 mm or less from each other are adopted.

Figure 2:
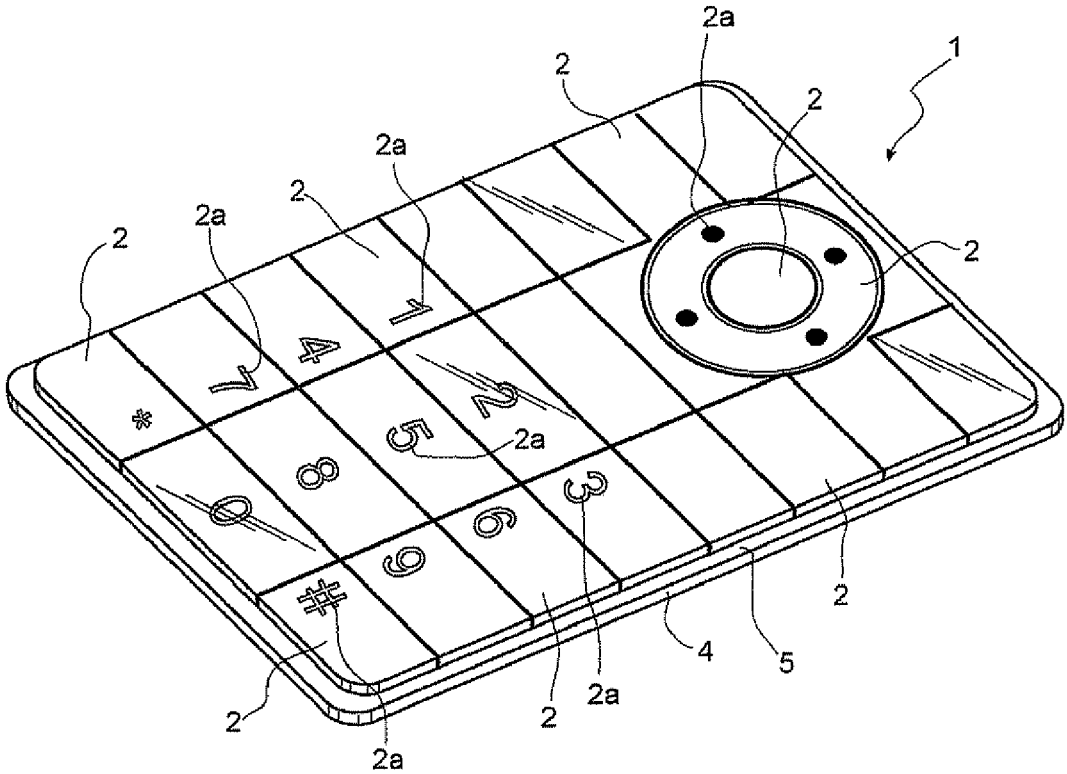
FIG. 2 is a perspective view showing a key sheet of the present invention being removed from a portable phone.

FIG. 2 shows a single piece of a key sheet 1 of the present invention being removed from a portable phone. FIG. 2 is a perspective view showing, in an enlarged manner, the external appearance of the key sheet 1 of the present invention as an assembly which comprises a plurality of key tops 2, 2, . . . , and a key pad 4 disposed at the underneath thereof. The key tops 2, 2, . . . are arranged in a predetermined array on the key pad 4, and are adhered to each other with a transparent adhesive. In the perspective view of FIG. 2, most part of the base portion, as mentioned later, of the key pad 4 is covered with the key tops 2, 2, . . . , and thus only the periphery thereof can be seen. Therefore, even if the base portion is made of a resin or made of a metal, it looks similar in its external appearance.

Example 1

Figure 3:
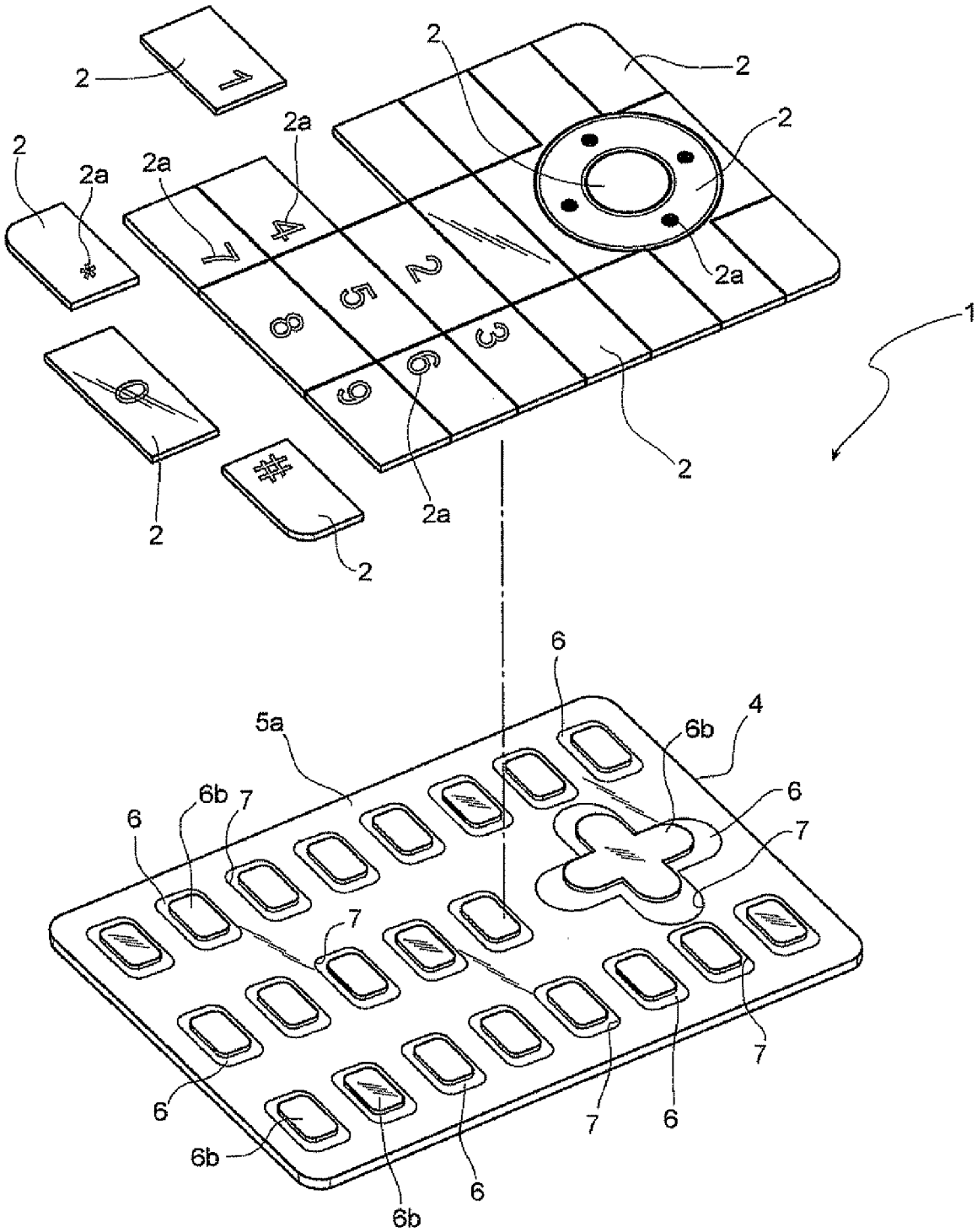
FIG. 3 is an exploded perspective view showing a metal key top portion and a key pad portion at the underneath thereof, exploded from a key sheet of the present invention.

FIG. 3 is an exploded perspective view showing schematically in an enlarged manner how the key sheet 1 of the present invention shown in FIG. 2 is configured. The upper half of this exploded perspective view shows the state that the key tops 2, 2, . . . made of a metal as each individual intermediate component are assembled. The lower half of the exploded view shows a base portion 5 in the shape of a thin sheet to be assembled with each individual key top 2, 2, . . . made of a metal, and a plurality of key top arranging portions 6 molded integrally with the base portion 5.

Figure 8:
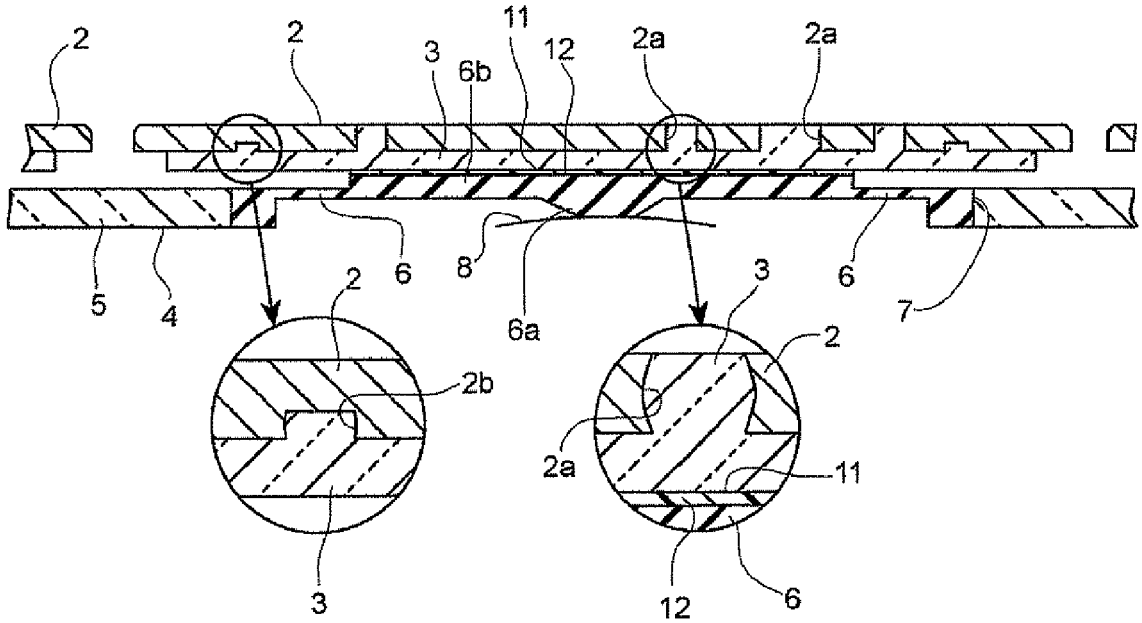
FIG. 8 is a longitudinal sectional view of a key sheet of the present invention, showing, in a further enlarged manner, holes of letters, symbols or the like of a key top and a concave portion at the back surface thereof.

The base portion 5 of the key pad 4 is a portion with a flat plate shape made of a hard resin 5*a* such as a polycarbonate resin or the like, or made of a metal 5*b* such as a stainless steel or the like, and a plurality of holes 7, 7, . . . are provided thereon. The key top arranging portion 6 fills up the hole 7 of the above-mentioned base portion 5 and made of an elastic material such as a silicone rubber, a thermoplastic elastomer or the like which is bonded integrally with the base portion 5. Further, as shown in FIG. 8, each key top arranging portion 6 has a contact pressing projection (pressing element) 6*a* and a pedestal 6*b* projecting in opposing directions. The contact pressing projection 6*a* presses a metal dome (contact member) 8 disposed at the underneath thereof so that a normally open contact provided on a printed circuit board (not shown) is closed.

The pedestal 6*b* is a part for supporting the key top 2 by adhering the key top 2 on the top surface thereof. Since the base portion 5 is formed out of a hard resin or a metal (as mentioned later), the key pad 4 is hardly deformed. Therefore, the key sheet 1 can have the shape stability. That is, as shown in FIG. 1, even if a key sheet 1 is attached to the casing of a portable phone in a state not supported by its periphery, it can maintain a predetermined shape along the case shape of a portable phone at its periphery. The key pad 4 having such a configuration is formed by means of insert molding or two-color molding.

Example 2

Figure 9:
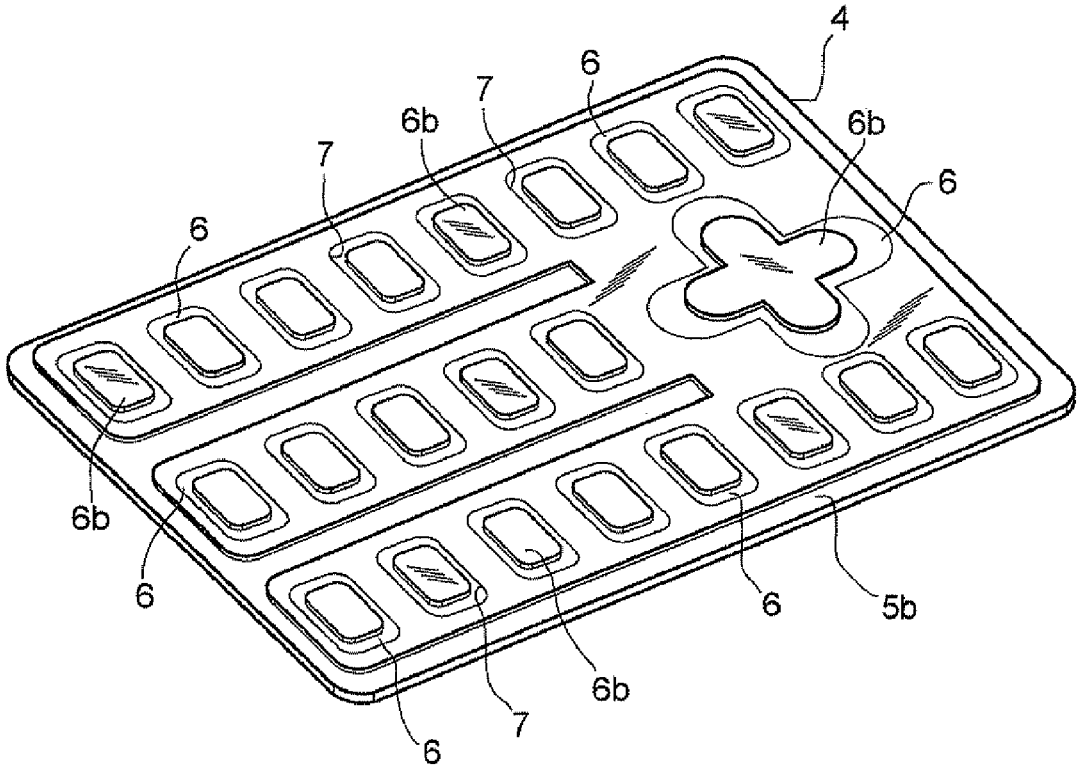
FIG. 9 is a perspective view showing an embodiment where a base portion made of a resin of a key pad shown in FIG. 3 is replaced by the one made of a metal.
Figure 10:
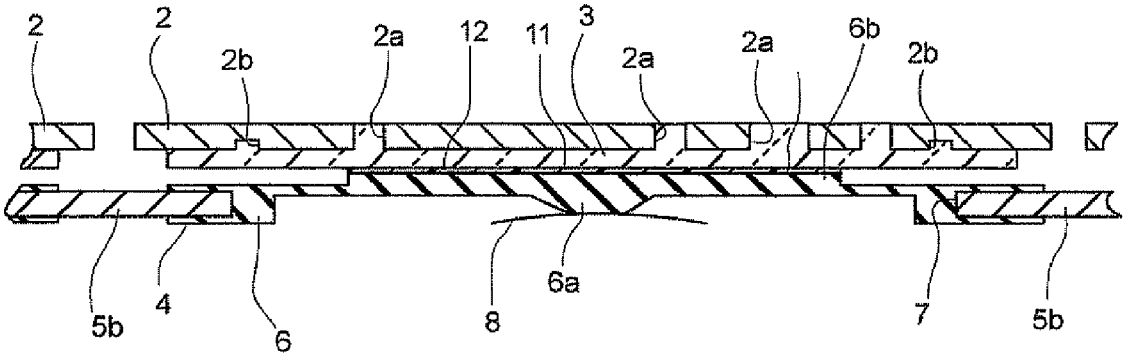
FIG. 10 is a sectional view of a key sheet in which a key pad shown in FIG. 8 is used.

Regarding the base portion 5 of the key pad 4 in Example 1, a structural example in which the base portion 5*a* made of a resin 5*a* is replaced with the base portion 5*b* made of a metal is illustrated as Example 2 in FIGS. 9 and 10. As the types of metal plates used for the base portion 5*b*, it is sufficient to appropriately select an arbitrary metal plate such as stainless steel, aluminum, titanium or the like. The thickness of the metal plate is 0.2 mm or less. In order to improve the close contact between the base portion 5*b* made of a metal and an elastic material such as a silicone rubber, a thermoplastic elastomer or the like which forms the key top arranging portion 6, the periphery of the opening edge of the hole 7 is also covered with an elastic material on the top surface and undersurface of the base portion 5*b*, as shown in FIG. 10. That is, the opening edge of the hole 7 is configured to be sandwiched between the upper and the lower parts of the elastic material constituting the key top arranging portion 6. In addition, the key pad 4 having a base portion 5*b* made of a metal is usually formed by means of insert molding.

Regarding the base portion 5 of the key pad 4 even if the base portion 5*a* made of a resin 5*a* is replaced with the base portion 5*b* made of a metal, there is almost no difference in its external appearance because the part of the key top 2, 2, . . . shares most of the part attracting the attention and the key pad 4 only constitutes a small area surrounding its peripheral portion as shown in FIG. 2. The advantage of Example 2 is such that since a metal has higher mechanical strength than a resin, the thickness of the base portion 5*b* can be thinner than in the case using a resin. Specifically, the thickness of about 0.1 mm is possible.

Example 3

Figure 4:
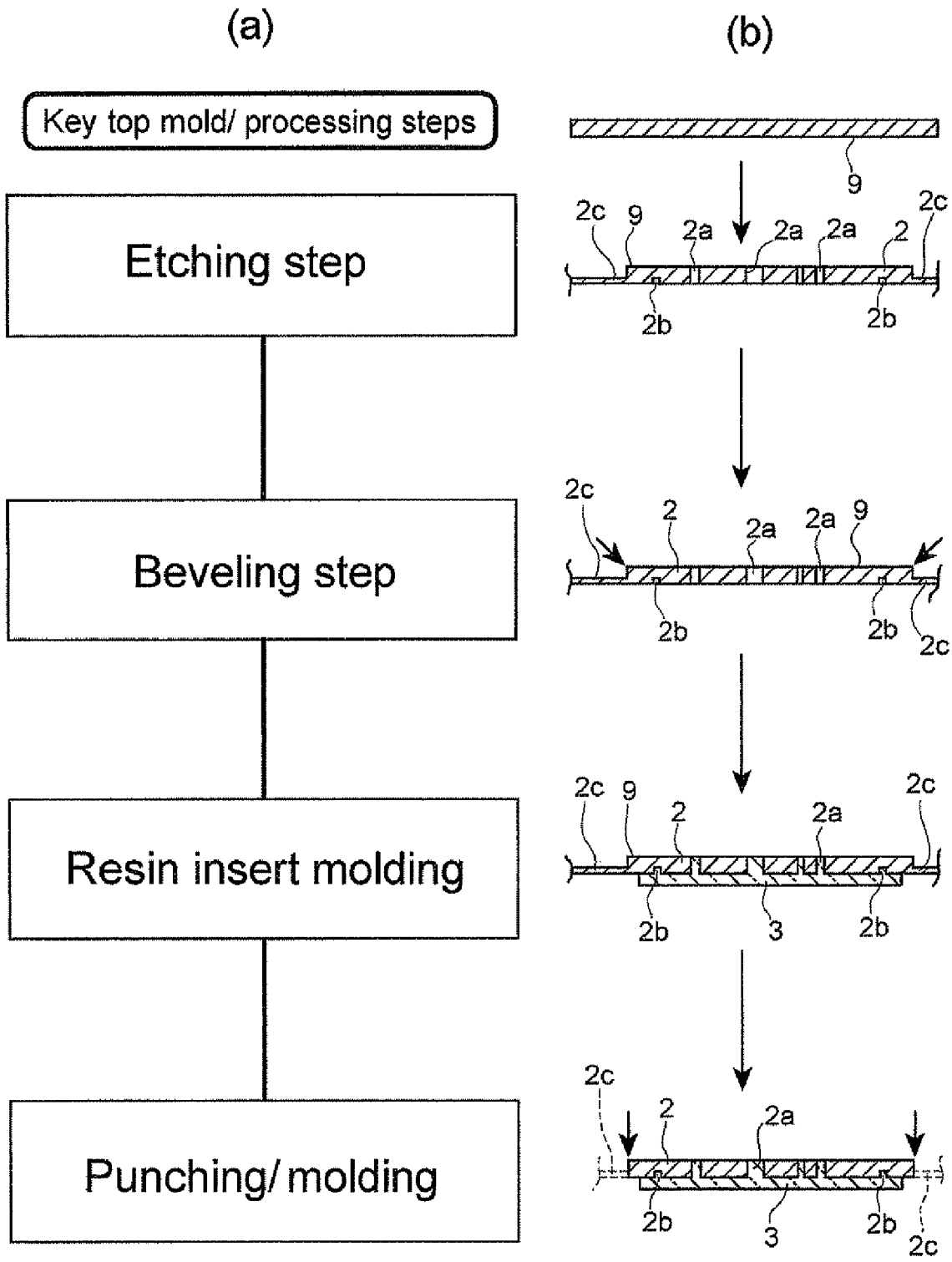
FIG. 4(*a*) is a flow chart showing mold/processing steps of a key top made of a metal which is a component of a key sheet of the present invention, and FIG. 4(*b*) is a diagram showing the state that each individual key top is processed through the above-mentioned each step.

In the next place, the production steps of the key top 2 in the key sheet 1 of the present invention are shown with reference to FIG. 4. FIG. 4(*a*) at the left side is a flow chart showing mold/processing steps of the key top 2, and FIG. 4(*b*) at the right side is a diagram showing the processing status of each individual key top 2 according to each step shown at the left side. Each step proceeds as follows.

1) Preparation of a Metal Plate:

A thin metal plate 9 having a size (area) on which a plurality of various key tops can be arranged is provided. For a type of the metal plate 9, it is sufficient to appropriately select an arbitrary metal plate such as stainless steel, aluminum, titanium or the like which is likely to match the preference of users, and there is no need to use a specific metal. A metal plate with thickness of 0.05 to 0.2 mm is used for the metal plate 9. The thickness of this range is preferable, taking into consideration the balance between the thinning of the key top and the strength of the key top. The metal plate 9 (key top 2) usually tends to come under the influence of stress due to the lowered strength when the thickness is 0.1 mm or less. Therefore, it cannot return to the original state from the deflected state due to the stress. However, the key sheet of the present invention is provided with a resin layer 3 on the back surface of each key top 2, 2, . . . formed out of a metal plate 9, and thus the strength against stress would be sufficient. Therefore, it will hardly deflect due to the stress.

2) Etching Step:

Full etching is carried out in order to form letter holes 2*a*, 2*a*, . . . penetrated from the front surface to the back surface showing the function of the respective key tops 2, 2, . . . on the metal plate 9. Half etching (which means the etching being carried out halfway in the thickness of the metal plate without etching full depth) to form a rough shape of the outline of each key top 2 is also carried out together. The letter holes 2*a* formed by means of full etching needs to be penetrated holes so as to transmit an illumination light from the backside when it is incorporated into a portable phone, and the letter holes 2*a* can be formed by means of press molding, laser etching, chemical etching or the like.

Further, a concave portion 2*b* is provided by means of half etching on several points of a part corresponding to the back surface of the key top of the metal plate 9. This concave portion 2*b* is intended to maintain the close contact between the resin and the metal in the key top 2, that is, intended to prevent the resin layer 3 from being removed from the metal plate 9 due to the shrinkage of a resin at the time of hardening. The concave portion 2*b* is provided in order that a part of a resin of the resin layer 3 formed by means of insert molding at the subsequent step is filled into the concave portion 2*b* to serve as an anchor.

3) Beveling Step:

4-Round beveling is carried out for each individual key top 2 by means of pressing (while this step is not an essential requirement, it is desirable to be carried out). The upper part of the side of the key top 2 is formed into a slant surface like an approximately tapered shape (shown in the diagonal arrow).

Figure 5:
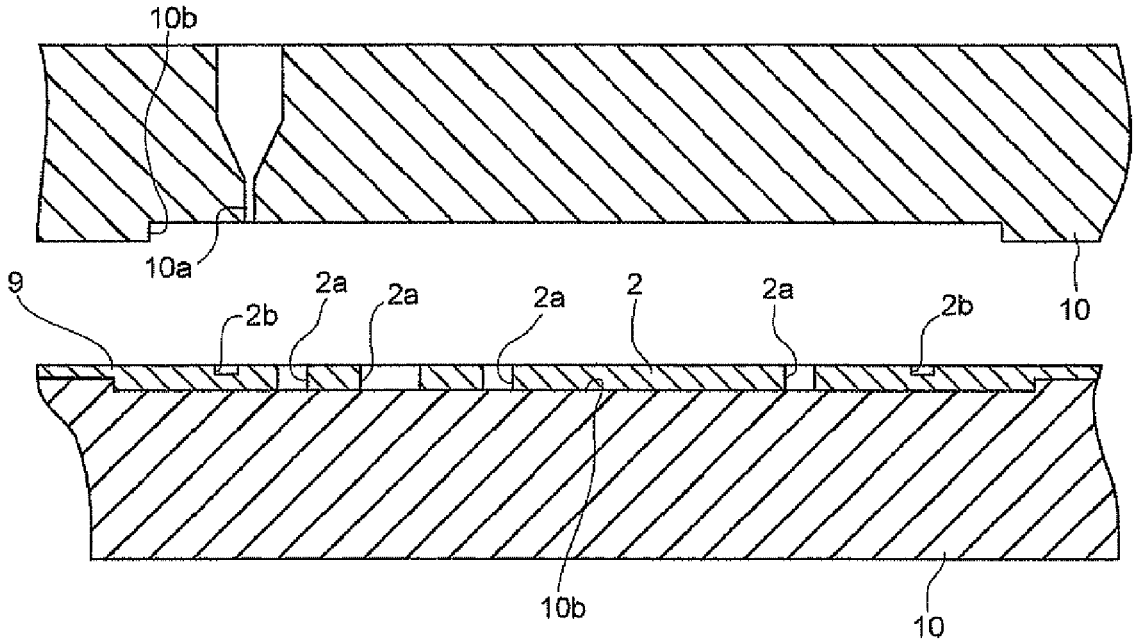
FIG. 5 is an enlarged longitudinal sectional view showing a step of filling a resin material by means of insert molding, in which FIG. 5(*a*) shows the state before mold clamping of a molding die that a metal plate is disposed inside a cavity, and FIG. 5(*b*) shows the state after mold clamping that a resin in liquid form is injected into a cavity.
Figure 5:
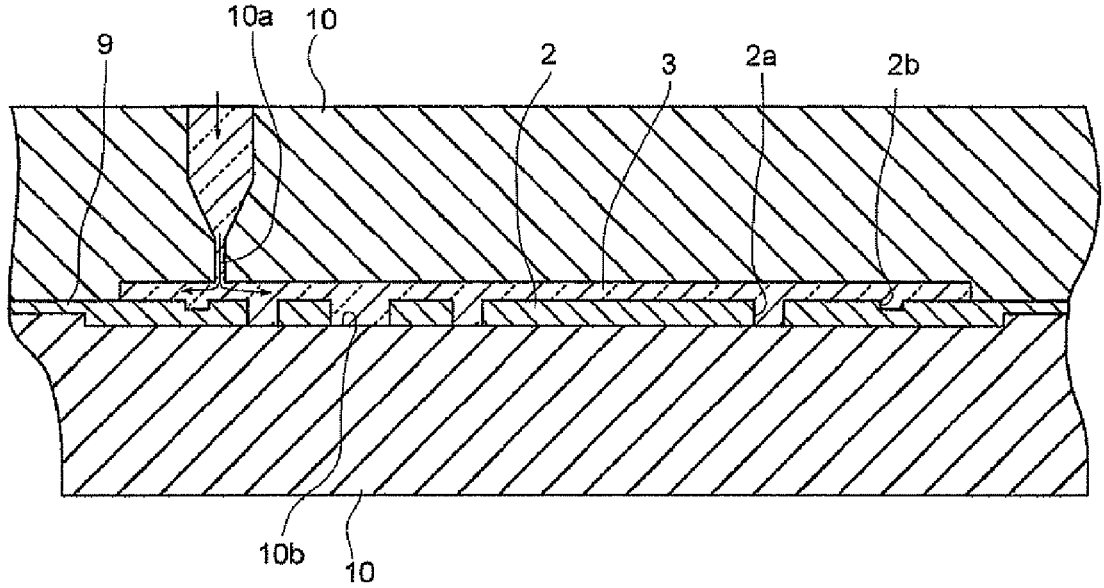

4) Resin Insert Molding Step:

A resin layer 3 with a thickness of 0.1 to 0.3 mm is provided on the back surface of the key top 2 by insert-molding with the metal plate 9 using, for example, a molding die 10 shown in FIG. 5. In FIG. 5, FIG. 5(*a*) shows the state before mold clamping of a molding die that the metal plate 9 is disposed inside a cavity, and FIG. 5(*b*) shows the state after mold clamping that a resin in liquid form is injected into a cavity.

In this step, a resin which becomes the resin layer 3 after curing is injected into a cavity 10*b* from a gate portion 10*a* of a molding die 10, to be filled into a portion which becomes the resin layer 3 of the key top 2 of the inserted metal plate 9 and also filled into each letter hole 2*a*. Further, the thickness of the resin layer 3 needs to be as thin as possible since the key sheet 1 is a thin key. However, taking into consideration the fluidity of a resin to be injected at the time of insert molding, there is a limitation for thinning. That is, when the thickness of the resin layer 3 is 0.1 mm or less, the resin does not spread across an entire portion which becomes the resin layer 3 of the cavity, which results in leading to an imperfect shape. Further, when the thickness of the resin layer 3 is 0.3 mm or more, it is too thin and will prevent thinning of the key sheet 1. Taking these matters into consideration, the thickness of the resin layer 3 is ranged from 0.1 to 0.3 mm.

As the resin (resin constituting the resin layer 3) to be used in this step, a hard or soft resin material such as PC (polycarbonate), PE (polyethylene), PET (polyethylene terephthalate), PMMA (metal polymethacrylate/acryl), PMP (polymethyl pentene), silicone resin, silicone rubber or the like can be used. An available resin is at least transparent (at least translucent), and a resin which has good mold-ability and fluidity can be used, whether it may be a colored one or a colorless one. Further, a thermoplastic resin such as PA (polyamide) or the like, or various thermoplastic elastomers or the like can also be used.

5) Punching/Molding Step:

The key tops 2, 2, . . . having letter holes 2*a*, 2*a*, . . . such as individual letters/symbols or the like formed on the metal plate 8 are separated from their peripheral half-etched portions 2*c* by means of punching.

Figure 6:
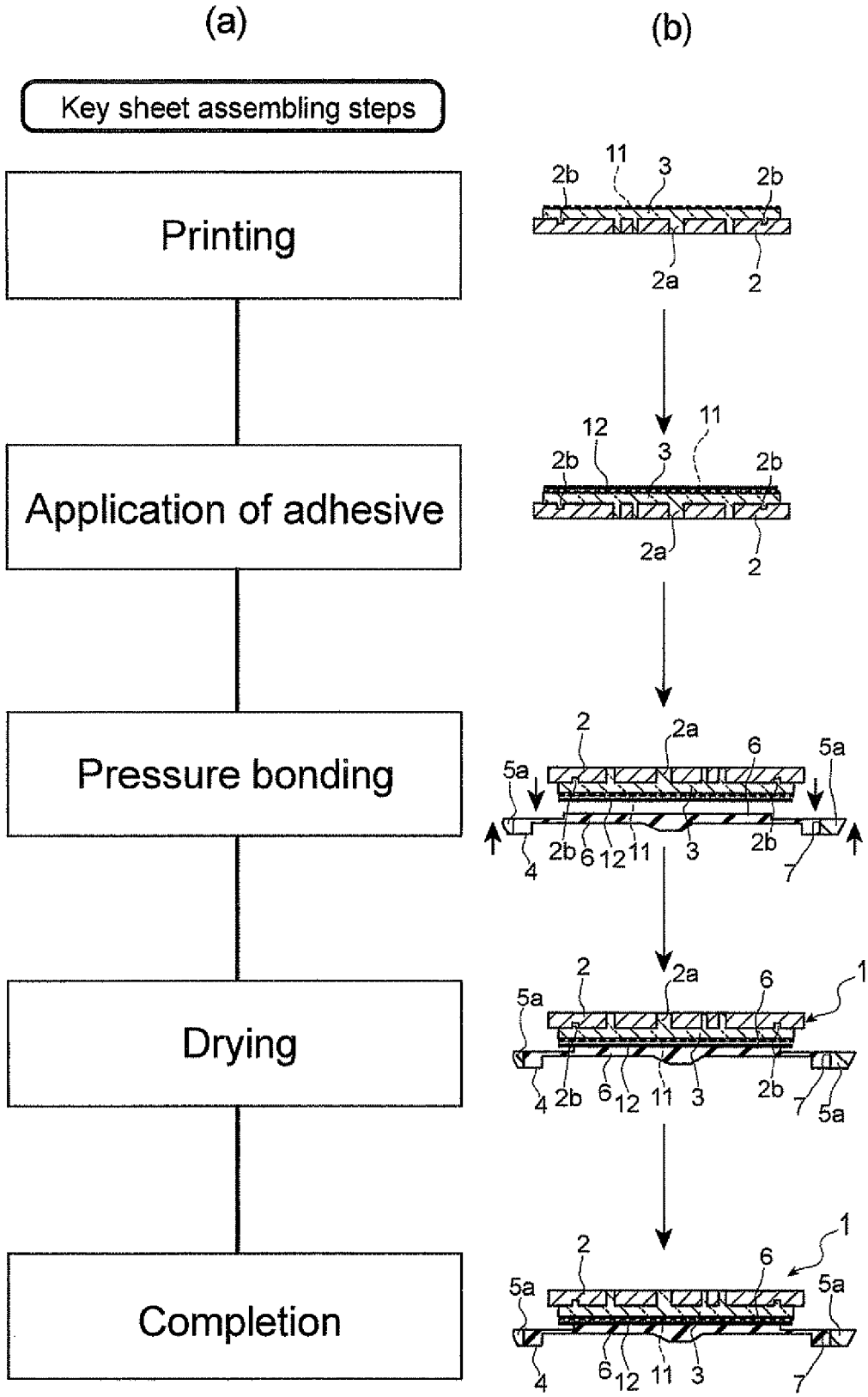
FIG. 6 (*a*) is a flow chart showing steps of assembling a key sheet of the present invention, and FIG. 6(*b*) is a diagram showing the state that a key sheet is processed through the above-mentioned each step.

The flow chart of FIG. 4 shows the steps up to punching/molding step, and the subsequent steps of assembling the key sheet are shown in FIG. 6. FIG. 6(*a*) at the left side is a flow chart showing the steps for assembling the key sheet 1, and FIG. 6(*b*) at the right side is a diagram showing the processing status of each individual key sheet 1 according to each step shown at the left side. Each step proceeds as follows.

Figure 7:
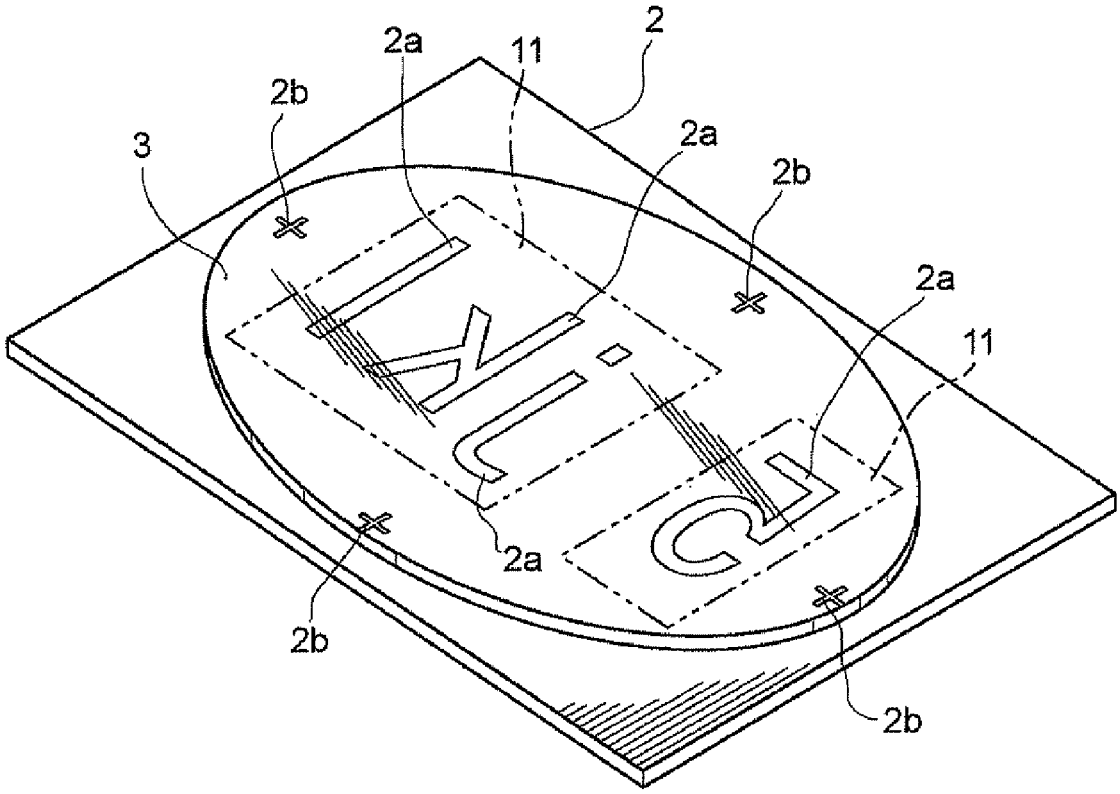
FIG. 7 is a perspective view showing, in an enlarged manner, the state of a key top made of a metal seen from the backside which is a component of a key sheet of the present invention.

6) Printing Step:

A surface treatment (this surface treatment is not essential) by an appropriate method is applied on the surface of the resin layer 3 (a face at the back surface side of the key top 2), before a set of key tops 2, 2, . . . having individual letter holes 2*a*, 2*a*, . . . is adhered onto the above-mentioned key pad 4, and a coated film 11 is formed by a clear (colorless transparent) or white coating. In a case where color painting is carried out for the purpose of the coloring of letters, the coated film 11 is formed by color (colored) coating+clear (or white) coating (there is a case where a layer of clear or white coating is not necessary depending on colors). FIG. 7 shows the state that only the coated films 11 by means of color printing provided respectively for the purpose of coloring are formed in a part corresponding to the numerical and alphabetical letter holes 2*a*, 2*a*, . . . on the surface of the resin layer 3.

The coating film 11 constitutes the back surface of the key top 2 (on the resin) or an adhered face between the pedestal 6*b* of the key pad 4 and the key top 2. Further, color printing is not necessarily carried out throughout the entire surface of the resin layer 3 for the purpose of the coloring of the letters. It is enough to carry out the color printing so as to cover a letter holes 2*a* of the key top 2 sufficiently. Further, the printing method used in this step is not particularly limited, and it is sufficient to use appropriate one such as pad printing, screen printing or the like. Further, it is also possible to use a spray coating instead of a printing.

Conventionally, when a coating film for coloring the letter holes 2*a* of the key tops 2, 2, . . . at the time of illumination is provided on the adhered surface of the pedestal 6*b* of the key top arranging portion 6, since the top surface (adhered surface) of the above pedestal 6*b* is smaller than the back surface of the key top 2, in particular, the coating film sometimes deviates from the part where the letters, symbols or the like are formed. Therefore, it could not correspond to the size of the letter hole 2*a*. However, in the key sheet 1 of the present invention, the resin layer 3 on the back surface of the key top 2 is large enough to cover the part where the letter holes 2*a* are formed, so that the coating film 11 (in particular, the part of color coating) can be formed in a size necessary and sufficient to cover the letter holes 2*a*. Therefore, the above-mentioned problem does not occur.

7) Adhesive-Applying Step:

After the above-mentioned printing step, an adhesive 12 having transparency or translucency is applied onto the back surface of the key top 2, 2, . . . or the top surface of the pedestal 6 of the key pad 4. It is sufficient to apply the adhesive 12 in an arbitrary manner. While the method thereof is not particularly limited, it is effective to use a dispenser.

8) Pressure-Bonding Step:

Each key top 2 is positioned to a predetermined position on the key pad 4 after the application of the adhesive, and then pressure-bonded/fixed. Thereby, the key sheet 1 can be apparently obtained. A step of modifying the surface of the key top 2 (the surface of the printed layer 11) may be added before adhesion (before the application of adhesive). It is desirable to utilize surface modification treatment by means of what is called atmospheric-pressure plasma for the modification step, since the key top 2 is made of a metal. Further, a method other than the surface modification by means of the above atmospheric-pressure plasma or by application of an annealing agent can be applied for the surface modification of the silicone rubber or the like of the adhered surface of the key pad 4, that is, the pedestal 6*b* of the key top arranging portion 6 as well as by means of the atmospheric-pressure plasma.

9) Drying Step:

A drying step is carried out for securing the fixing of each key top 2 which was pressure-bonded/fixed onto the key pad by means of solidification of the key sheet 1 with the adhesive 12. The content of the drying step varies depending on the types of the adhesive 12. For example, it should be left to stand for a certain amount of time in a case where the adhesive 12 is a solvent-vaporization type; the entire key sheet should be heated to a predetermined temperature for a certain amount of time in a case where the adhesive 12 is a thermosetting type; UV (ultraviolet ray) or the like should be irradiated for a certain amount of time in a case where the adhesive 12 is a UV effect type. When the adhesive 12 is solidified, after processed according to the above-mentioned each step, the fixing of the key tops 2, 2, onto the key pad 4 is securely done, so that the key sheet 1 is completed.

As shown in the partial enlarged view of FIG. 10, the internal peripheral wall of the letter hole 2*a* or the concave portion 2*b* formed by means of chemical etching, in particular, is not linear in their sectional shapes, but has an arc shape whose diameter at the central part in the depth direction of the hole is larger than those at other parts (exaggeratedly drawn in the diagram). Therefore, this configuration can enhance the strength of close contact between the key top 2 and the resin layer 3, in addition to the above-mentioned anchor effect.

INDUSTRIAL APPLICABILITY

Since the present invention relates to a thin key sheet for use in mobile equipment such as a portable phone, a personal digital assistants (PDA) or the like, it has a wide range of applicability in industrial fields seeking thinner configuration of these equipment provided with key switches, including manufacturing industries of electronic equipment and the various components thereof.

EFFECT OF THE INVENTION

1) Even though a key top is made of a metal, a key top can be fixed onto a key pad in a method similar to a conventional key sheet using a key top made of a resin because the adhered portion in the back surface of the key top is constituted by a resin, and a silicone rubber, a thermoplastic elastomer or the like, or by a printed layer, and a silicone rubber a thermoplastic elastomer or the like (in a case where a colored printed layer is provided on the surface of a resin layer on the back surface of a key top).

2) The surface of the key top can be evened, which can improve the finger feeling or hand feeling because the letter holes of a key top are filled with a resin. Further, it can prevent an adhesive from spilling out through the letter holes at the time of adhering between the key top and the key pad by filling a resin into the letter holes.

DESCRIPTION OF SYMBOLS

1: Key sheet
2: Key top
2*a*: Penetrated hole (letter hole) in the shape of letters, symbols or the like
2*b*: Concave portion
2*c*: External etching
3: Resin layer
4: Key pad
5: Base portion
5*a*: Base portion made of a resin
5*b*: Base portion made of a metal
6: Key top arranging portion
6*a*: Contact pressing projection
6*b*: Pedestal
7: Hole
8: Metal dome
9: Metal plate
10: Molding die
10*a*: Gate portion
10*b*: Cavity
11: Printed layer (ink)
12: Adhesive

The invention claimed is:

1. A key sheet comprising:

a plurality of thin key tops made of a metal having penetrated holes for displaying letters, symbols or the like by means of press molding, laser etching, chemical etching or the like, a resin layer having translucency adhered onto a back surface of said key top and filled into said penetrated holes, and a key pad comprising a base portion with a thin sheet shape and a plurality of key top arranging portions having a contact pressing projection formed integrally with said base portion, wherein said plurality of key tops and said key pads are fixed together through the intermediary of said resin layer adhered onto the back surface of said key top with an adhesive having transparency or translucency.

2. The key sheet according to claim 1, wherein a plurality of concave portions are formed on the back surface of said key top by means of press molding, laser etching or chemical etching, and a resin is also filled into said concave portion so as to enhance the close contact between the metal and the resin layer.

3. The key sheet according to claim 1, wherein the base portion of said key pad is formed out of a hard resin, and said key top arranging portion is formed out of an elastic material such as a silicone rubber, a thermoplastic elastomer or the like.

4. The key sheet according to claim 1, wherein a coating film for coloring letters or the like when illuminated from the back surface is formed on a whole or a part of the surface of the resin layer on the back surface of said key top.

5. The key sheet according to claim 1, wherein the resin layer on the back surface of said key top is constituted by a hard or soft resin having translucency and being excellent in mold-ability and fluidity such as a polycarbonate resin, a polyethylene resin, a polyethylene terephthalate resin, a methyl polymethacrylate resin, a polymethyl pentene resin, a silicone resin, a silicone rubber or various thermoplastic elastomer or the like.

6. The key sheet according to claim 1, wherein the thickness of the metal plate constituting said key top is 0.05 to 0.2 mm and the thickness of the resin layer on the back surface of said key top is 0.1 to 0.3 mm.

7. A production method of a key sheet which supports a plurality of key tops made of a metal, displaying predetermined letters, symbols or the like on a common key pad, the method comprising the steps of:

preparing a thin metal plate having a size (area) on which the key tops can be arranged and having a thickness of about 0.05 to 0.2 mm;

forming penetrated holes constituting letters, symbols or the like on said metal plate by means of press molding, laser etching, chemical etching or the like;

providing a resin layer having translucency and having a thickness of 0.1 to 0.3 mm on one surface of said metal plate by means of insert molding which is carried out such that said metal plate is placed in a die;

separating the key tops having letters, symbols or the like individually from said metal plate by means of the punching;

molding a key pad comprising a base portion with a sheet shape and a plurality of key top arranging portions having a contact pressing projection; and adhering each individual key top having a letter, symbol or the like separated by means of the punching onto said key top arranging portions of said key pad.

* * * * *